United States Patent [19]

Frey

[11] Patent Number: 4,951,903

[45] Date of Patent: Aug. 28, 1990

[54] BAG HOLDER

[76] Inventor: Wilfred Frey, 9655 Alcott Road, SE., Calgary, Alberta, Canada, T2J 0T7

[21] Appl. No.: 360,796

[22] Filed: Jun. 2, 1989

[51] Int. Cl.[5] ..... B65B 67/12

[52] U.S. Cl. ..... 248/99

[58] Field of Search ..... 248/95, 97, 99, 100, 248/101; 141/316, 390, 391; 383/33

[56] References Cited

U.S. PATENT DOCUMENTS

| | | | |
|---|---|---|---|
| 3,927,445 | 12/1975 | Pavlish | 248/95 |
| 3,934,803 | 1/1976 | Paulus, Jr. | 141/390 |
| 4,223,858 | 9/1980 | de Salazar | 248/101 |
| 4,659,045 | 4/1987 | Flynn | 248/99 |
| 4,664,348 | 5/1987 | Corsaut | 248/99 |
| 4,750,695 | 6/1988 | Greenhouse | 248/99 |
| 4,805,858 | 2/1989 | Taylor | 248/99 |
| 4,832,291 | 5/1989 | Nelson | 248/99 |

FOREIGN PATENT DOCUMENTS

| | | | |
|---|---|---|---|
| 2014488 | 10/1971 | Fed. Rep. of Germany | 248/99 |
| 958658 | 5/1964 | United Kingdom | 248/101 |

*Primary Examiner*—J. Franklin Foss
*Assistant Examiner*—Robert A. Olson
*Attorney, Agent, or Firm*—Rogers, Bereskin & Parr

[57] ABSTRACT

A bag holder for holding the mouth of a bag open comprises a member defining an opening adapted to be received in the mouth of a bag and a flexible, resilient, elongate loop adapted for location around the exterior of the bag and the member to retain the bag on the member and hold the mouth of the bag open. The holder may be provided in the form of a kit of parts, the member being formed of elongate first and second parts of thin and flat edge overall, the first part being relatively rigid and the second part more flexible and longer than the first part. The free ends of the second part are adapted for engaging respective end portions of the first part to form the parts into a bow-shaped configuration defining an opening.

7 Claims, 2 Drawing Sheets

BAG HOLDER

FIELD OF THE INVENTION

This invention relates to a bag holder for holding the mouth of a bag open, and also to a kit of parts for forming such a bag holder.

BACKGROUND OF INVENTION

Various forms of holders for holding the mouth of a plastic garbage bag open are known. Such holders conventionally comprise a stiff bow-shaped member defining an opening, a straight portion of the member being adapted for mounting to a vertical surface. The top of the bag is located in the opening and the end of the bag folded over the member. A bow-shaped rod or band is often provided to hold the bag in place and is typically pivoted to the rear of the straight portion of the member and is moveable to a position where the rod frictionally engages the bag between the rod and the exterior of the member. Such holders tend to be of relatively heavy construction and consequently are difficult to transport, handle and mount.

SUMMARY OF THE INVENTION

According to the first aspect of the present invention, there is provided a bag holder for holding the mouth of a bag open, comprising a first member defining an opening and adapted to be received in the mouth of a bag and a flexible, resilient, elongate loop adapted for location around the exterior of the bag and the first member to retain the bag on the first member and hold the mouth of the bag open.

Preferably, the member defines a bow-shape and includes a substantially straight first portion and a curved second portion.

According to a further aspect of the present invention, there is provided a kit of parts for forming a bag holder, comprising elongate first and second members of thin and flat shape overall, the first member being relatively rigid and the second member more flexible and longer than the first member, the free ends of the second member being adapted for engaging respective end portions of the first member to form the second member into a bow-shaped configuration and, with the first member, define an opening, and a flexible, resilient, elongate loop for location around the exterior of the first and second members and adapted to retain a bag mouth open on the exterior of the first and second members.

BRIEF DESCRIPTION OF THE DRAWINGS

These aspects will now be described, by way of example, with reference to the accompanying drawings of a preferred embodiment of the present invention, in which.

DETAILED DESCRIPTION OF PREFERRED EMBODIMENT

Figure 1:
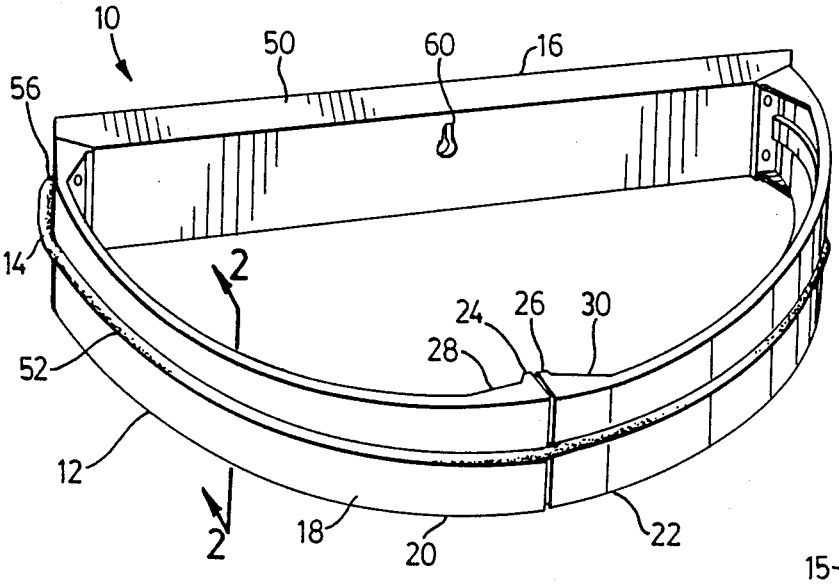
FIG. 1 is a perspective view of a bag holder in accordance with the preferred embodiment of the present convention.
Figure 2:
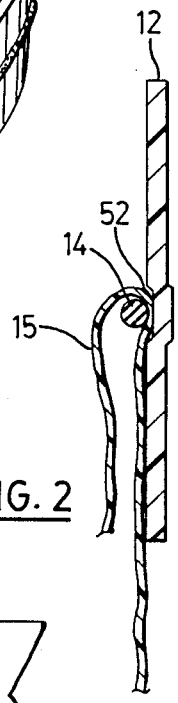
FIG. 2 is a sectional view on line 2—2 of FIG. 1 and also showing a part of a bag.

Reference is made first to FIG. 1 of the drawings, which shows a bag holder 10 in accordance with a preferred embodiment of the present invention. The holder 10 comprises a bow-shaped member 12 which defines a complementary bow-shaped opening and a flexible resilient elongate continuous loop 14 for location around the exterior of the member. In use, the member 12 is placed within the mouth of a garbage bag and the loop 14 then located around the outside of the bag and the member 12 to retain the bag on the member 12 and also hold the mouth of the bag open. FIG. 2 of the drawings illustrates a typical section of the loop 14 retaining a bag 15 on the member 12.

The member 12 is formed of a plastic material and comprises a first portion 16, which forms the straight side of the bow, and a second portion 18, which forms the curved side of the bow.

Figure 4:
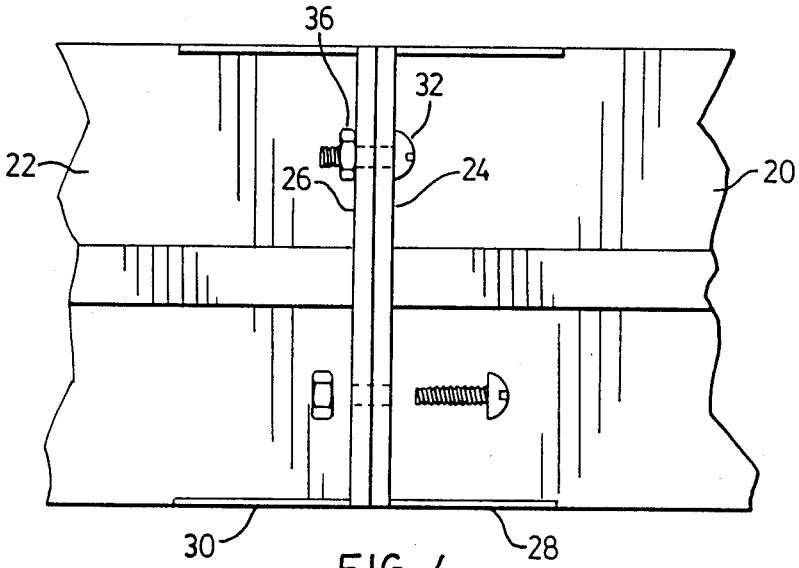
FIG. 4 is an enlarged view of the join between two parts of the bag holder of FIG. 1 (on the same sheet as FIG. 1).
Figure 3:
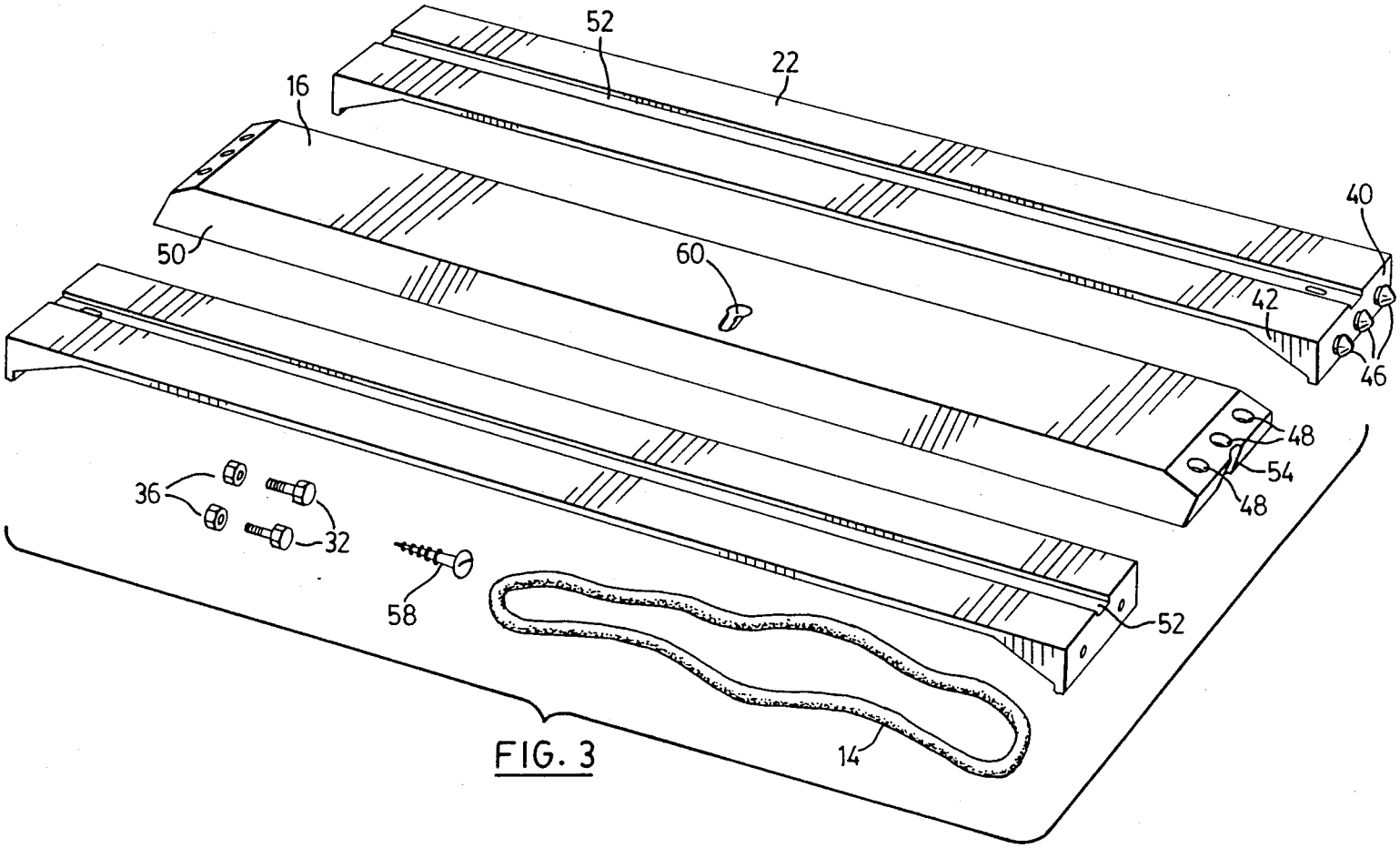
FIG. 3 is a perspective view of a kit of parts used to form the bag holder of FIG. 1.

For a more detailed description of the various parts of the bag holder 10, reference is now also made to FIG. 3 of the drawings, which shows a kit of parts which may be assembled to form the holder shown in FIG. 1. The second portion 18 of the member 12 is formed of two parts 20, 22, shown separated in FIG. 3. The parts 20, 22 are of substantially similar length to the first portion 16 and are joined to each other, end-to-end, at complementary respective flanges 24, 26 which extend normally to the respective parts 20, 22 and are provided with strengthening webs 28, 30 extending from the flanges 24, 26 to the respective parts 20, 22. Each flange 24, 26 is apertured to receive a pair of bolts 32 which are held in place by respective nuts 36, as is illustrated in FIG. 4 of the drawings.

From FIG. 3 it will be noted that the parts 20, 22 of the second portion 18, which are flexible, naturally assume a substantially straight configuration, and must therefore be deformed to achieve the bow-shape shown in FIG. 1. Engagement means are provided to retain the free ends of the second portion in the respective ends of the first portion 16. If reference is made to the part 22 of the second portion 18 illustrated in FIG. 3, it will be noted that the end of the part 22 is provided with a flange 40 and webs 42 (only one shown) similar to the arrangement for joining the parts 20, 22 to one another. However, the flange 40 is provided with three projections 46 which extend normally to the flange 40 for engaging complementary apertures 48 in the end of the first portion 16. The apertures 48 are formed in the first portion 16 at areas where the surface of the first portion 16 is inclined outwardly.

The majority of the inner surface of the first portion 16 is planar, though the leading edge 50 of the portion 16 tapers to facilitate the sweeping of material from a surface over the first portion and into a bag. Various stiffening webs and ribs (not shown) are provided on the outer surface of the portion such that the first portion 16 will retain its straight configuration when the bag holder is in use.

To locate the loop 14 on the exterior of the member 12, and facilitate retention of the bag on the holder, a groove 52 is provided on the exterior of the parts 20, 22 of the second portion and complementary notches 54, 56 are provided in the ends of the first portion 16. The loop 14, which is formed of spring steel, is slightly shorter than the distance around the member 12 such that it must be extended when it is positioned over the bag and the member. In addition to retaining the bag on the member 12, the loop 14 also serves to retain the projections 46 in the ends of the parts 20, 22 of the second portion 18 in the apertures 48 in the ends of the first portion 16.

In use, the bag holder 10 may be used in conjunction with, for example, a brush for sweeping up material from a floor, in which case the tapered leading edge 50 of the first portion 16 is laid on the floor, the taper facilitating the sweeping of material into the opening defined by the member 12, and thus into the garbage bag. Alternatively, the member 12 may be mounted on the vertical surface by means of a screw 58 (FIG. 3) driven into the surface, leaving a sufficient length extending from the surface to engage a necked aperture 60 in the first portion 16. The aperture 60 is located above the location of the loop 14 as it passes along the rear of the first portion 16 so that the member 12 may be mounted on the surface without affecting the positioning of the garbage bag.

Thus it will be seen that the bag holder described above provides a simple and convenient means for holding the mouth of a bag open. Also, the kit of parts which are assembled to form the bag holder are configured and sized for easy transportation and storage when the holder is disassembled.

It will be clear to those skilled in the art that the above description is merely exemplary, and that various modifications and improvements may be made to the illustrated bag holder without departing from the scope of the invention.

I claim:

1. A bag holder for holding the mouth of a bag open comprising:

a member defining a bow-shaped opening and adapted to be received in the mouth of a bag, the member including a substantially straight first portion and a separate, curved second portion, the free ends of the second portion being provided with projections and the ends of the first portion being provided with complementary recesses for receiving the projections, and the second portion being provided with an external recessed grove; and a flexible, resilient, elongate; continuous loop adapted for location around the exterior of the bag and the member to retain the bag on the member and hold the mouth of the bag open, the loop being adapted for location in the external recessed groove in the second portion of the member.

2. The bag holder of claim 1 wherein the first portion has a leading edge adapted for extending beyond the mouth of the bag and is of a reduced thickness relative to the remainder of the first portion to facilitate the sweeping of material from a surface over the first portion and into the bag.

3. The bag holder of claim 1 wherein the second portion is flexible and naturally assumes a substantially straight configuration and must be deformed to assume a curved configuration.

4. The bag holder of claim 1, 3 or 2 wherein the loop serves to retain the ends of the second portion in engagement with the respective ends of the first portion.

5. A kit of parts for forming a bag holder comprising:

elongated first and second members of thin and flat shape overall, the first member being relatively rigid and the second member more flexible and longer than the first member, the free ends of the second member being provided with projections and the ends of the first member being provided with complementary recesses for receiving the projections to form the second member into a bow-shaped configuration and, with the first member, defining an opening, the second member further being provided with an external recessed groove; and a flexible, resilient, elongate loop for location around the exterior of the first and second members and adapted to retain a bag mouth open on the exterior of said first and second members, the loop being adapted for location in the external recessed groove in the second member.

6. The kit of claim 5 wherein the second member is formed of two parts, the two parts being of substantially similar length to the first member, and further comprising joining means for joining the parts end-to-end.

7. The kit of claim 6 wherein the loop serves to retain the first and second members in the bow-shaped configuration.

* * * * *